US010093529B1

(12) United States Patent
Song et al.

(10) Patent No.: US 10,093,529 B1
(45) Date of Patent: Oct. 9, 2018

(54) ELECTRIC TINFOIL-CUTTING DEVICE FOR AUTOMATIC CORKSCREWS

(71) Applicant: Zhuhai Kelitong Electronic Co., Ltd., Zhuhai (CN)

(72) Inventors: Xiaoxian Song, Guangdong (CN); Haihong Zhu, Guangdong (CN)

( * ) Notice: Subject to any disclaimer, the term of this patent is extended or adjusted under 35 U.S.C. 154(b) by 0 days.

(21) Appl. No.: 15/593,349

(22) Filed: May 12, 2017

(30) Foreign Application Priority Data

Apr. 10, 2017 (CN) ..... 2017 2 0372200 U

(51) Int. Cl.
*B67B 7/04* (2006.01)

(52) U.S. Cl.
CPC .... *B67B 7/0405* (2013.01); *B67B 2007/0458* (2013.01)

(58) Field of Classification Search
CPC .. B67B 7/0405; B67B 2007/0458; B67B 7/04
USPC ..... 30/1.5; 81/3.08, 3.09, 3.2, 3.29
See application file for complete search history.

(56) References Cited

U.S. PATENT DOCUMENTS 5,351,579 A * 10/1994 Metz ..... B67B 7/0405 30/1.5
5,724,869 A * 3/1998 May ..... B67B 7/0405 81/3.08
6,321,620 B1 * 11/2001 Fabbro ..... B67B 7/0405 81/3.09
6,658,739 B1 * 12/2003 Huang ..... B23D 21/08 30/101
6,752,041 B2 * 6/2004 Lee ..... B67B 7/0405 81/3.2
7,775,140 B2 * 8/2010 Chan ..... B67B 7/0441 81/3.29
8,578,819 B2 * 11/2013 Cheung ..... B67B 7/0405 81/3.2
8,667,867 B2 * 3/2014 Mills ..... B67B 7/04 30/1.5
9,637,367 B1 * 5/2017 Arnold ..... B67B 7/0405
9,688,522 B2 * 6/2017 Song ..... B67B 7/0405

* cited by examiner

*Primary Examiner* — Hwei C Payer
(74) *Attorney, Agent, or Firm* — Prakash Nama; Global IP Services, PLLC

(57) ABSTRACT

The present utility model discloses an electric tinfoil-cutting device for automatic corkscrews, which comprises a reduction gearbox, a driving motor, a movable support and a blade assembly comprising a blade-mounting carrier and blade-mounting blocks, wherein the movable support are provided with support limit projections which are embedded in mounting carrier limit notches of the blade-mounting carrier, each of the blade-mounting blocks comprises a horizontal mounting block portion and a vertical mounting block portion, and a tinfoil-cutting blade is mounted on the vertical mounting block portion. The electric tinfoil-cutting device of the present utility model can achieve an automatic tinfoil-cutting function and has the advantages of novel structural design, high degree of automation, and convenience in use.

3 Claims, 3 Drawing Sheets

ELECTRIC TINFOIL-CUTTING DEVICE FOR AUTOMATIC CORKSCREWS

BACKGROUND OF THE INVENTION

The present utility model relates to the technical field of wine corkscrews, and in particular to an electric tinfoil-cutting device for automatic corkscrews.

A wine corkscrew is an auxiliary tool for pulling a winebottle cork out of the bottleneck of a winebottle. A common corkscrew normally comprises a main body for convenient holding by an operator and a screw connected to the main body. When held by hand and rotated, the main body drives the screw to screw into a cork, and then brings the cork out of a winebottle, thereby completing the winebottle opening. However, in actual use, the above-mentioned corkscrew has a lot of defects. For example, in order to open the winebottle, the winebottle must be positioned directly below the screw, and the screw must be located on the axis of the cork as much as possible. The winebottle is then held by the left hand with the right hand rotating and driving the screw into the cork, and the cock cannot be pulled out until the cork rotates relative to the bottleneck. As a result, the winebottle opening process is time-consuming and laborious, and the corkscrew is very inconvenient to use.

In order to overcome the defects existing in the above-mentioned manual corkscrew, automatic corkscrews have emerged which can automatically open the winebottles, and therefore are convenient to use.

However, for a conventional automatic corkscrew, in the process of opening a winebottle, it tends to use a tinfoil cutter to cut the tinfoil on the bottleneck; moreover, conventional tinfoil cutters are all operated manually, so that the process is time-consuming and laborious.

BRIEF SUMMARY OF THE INVENTION

In view of the defects in the prior art, the present utility model aims to provide an electric tinfoil-cutting device for automatic corkscrews which has the advantages of novel structural design, high automation degree and convenience in use, and can achieve an automatic tinfoil-cutting function.

In order to achieve the above-mentioned objective, the present utility model is implemented by the following technical solution.

Disclosed is an electric tinfoil-cutting device for automatic corkscrews, which comprises a reduction gearbox and a driving motor mounted at a lower end of the reduction gearbox, a power output shaft of the driving motor is connected to a power input end of the reduction gearbox, a movable support is mounted at an upper end of the reduction gearbox, a power output end of the reduction gearbox is connected to the movable support, and a support receiving cavity with an upward opening is formed in the movable support;

a blade assembly is embedded in the support receiving cavity of the movable support, the blade assembly comprises a blade-mounting carrier which is embedded in the support receiving cavity, the edge of the blade-mounting carrier is provided with at least two mounting carrier limit notches which both open radially outwardly and are completely through from the top down, an internal wall of the support receiving cavity is provided with inwardly raised and wedged support limit projections which correspond to the mounting carrier limit notches, respectively, and each support limit projection is provided with an inclined guide slope and is embedded in a corresponding mounting carrier limit notch; the blade-mounting carrier is provided, corresponding to respective mounting carrier limit notches, with blade-mounting holes which open radially outwardly and communicate with the corresponding mounting carrier limit notches, an L-shaped blade-mounting block is embedded in each blade-mounting hole, each blade-mounting block comprises a horizontally extending horizontal mounting block portion and a vertically extending vertical mounting block portion integrated with the horizontal mounting block portion, the horizontal mounting block portion of each blade-mounting block is embedded in the corresponding blade-mounting hole, an upper end of the vertical mounting block portion of each blade-mounting block extends to an upper end side of the blade-mounting carrier, and a tinfoil-cutting blade is mounted at an upper end of the vertical mounting block portion of each blade-mounting block; and a horizontal spring is embedded in each blade-mounting hole on the inner side of the horizontal mounting block portion of the corresponding blade-mounting block, an inner end of each horizontal spring abuts against the blade-mounting carrier, and an outer end of each horizontal spring abuts against the horizontal mounting block portion of the corresponding blade-mounting block.

An annular protective cover is buckled at the upper end of the movable support, and the protective cover is provided with a protective flange which inwardly protrudes and extends and is located at the upper end side of the tinfoil-cutting blades.

An upper end of the reduction gearbox is provided with retaining projections.

The present utility model has the following advantages that the electric tinfoil-cutting device for automatic corkscrews disclosed by the present utility model comprises the reduction gearbox, the driving motor mounted at the lower end of the reduction gearbox, and the movable support mounted at the upper end of the reduction gearbox, the power output end of the reduction gearbox is connected to the movable support, the blade assembly is embedded in the support receiving cavity in the movable support, the blade assembly comprises the blade-mounting carrier which is provided with the mounting carrier limit notches at its edge, the internal wall of the support receiving cavity is provided with the support limit projections, each support limit projection is provided with the guide slope, and the support limit projections are embedded in the mounting carrier limit notches; the blade-mounting carrier is provided with the blade-mounting holes, the L-shaped blade-mounting blocks are embedded in the blade-mounting holes, each blade-mounting block comprises the horizontal mounting block portion and the vertical mounting block portion, the horizontal mounting block portions are embedded in the blade-mounting holes and pushed outwardly by the horizontal springs, and the tinfoil-cutting blades are mounted at the upper ends of the vertical mounting block portions. By means of the above-mentioned structural design, the present utility model can achieve the automatic tinfoil-cutting function, that is, the electric tinfoil-cutting device of the present utility model has the advantages of novel structural design, high automation degree and convenience in use.

BRIEF DESCRIPTION OF THE DRAWINGS

The present utility model is further described below with reference to the drawings, but the embodiments in the drawings are not meant to limit the present utility model in any way, wherein.

Figure 1:
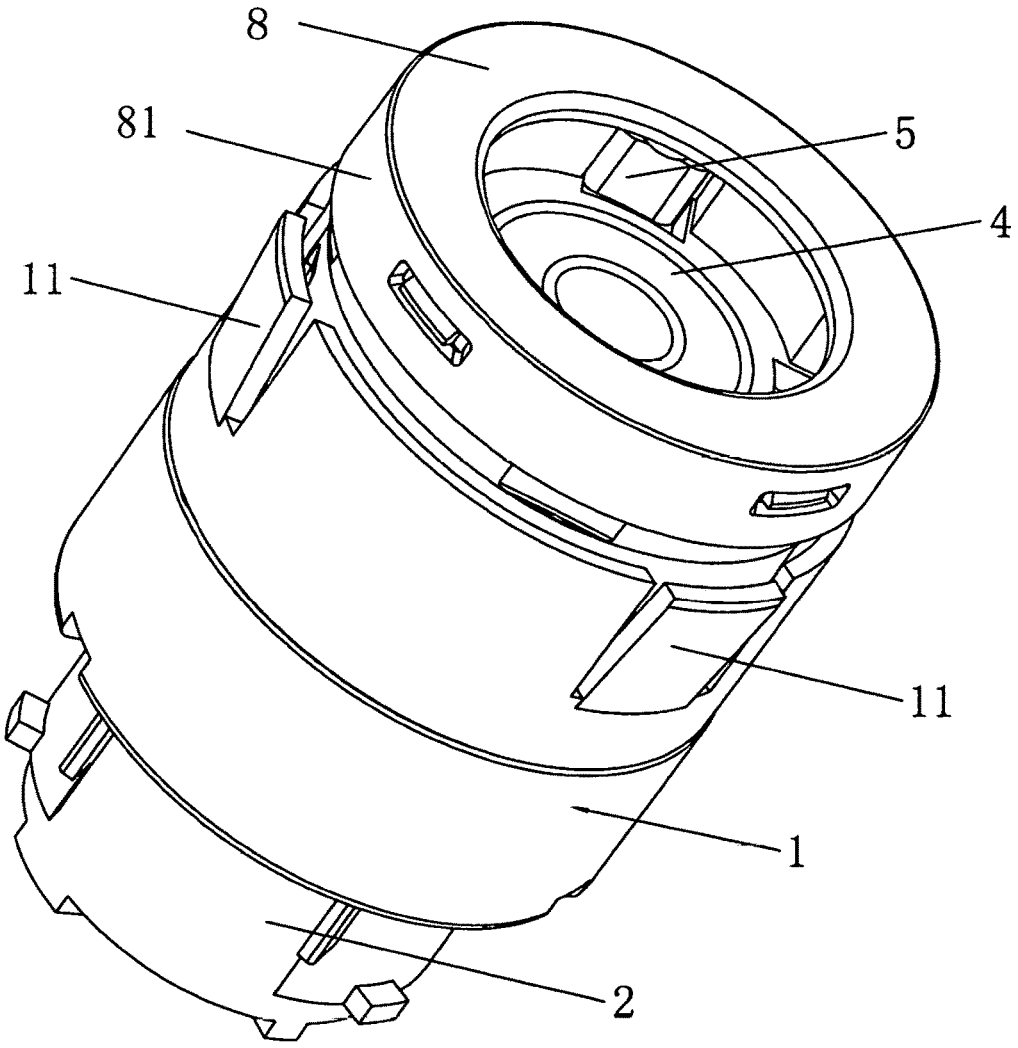
FIG. 1 is a schematic structural diagram of the present utility model.
Figure 2:
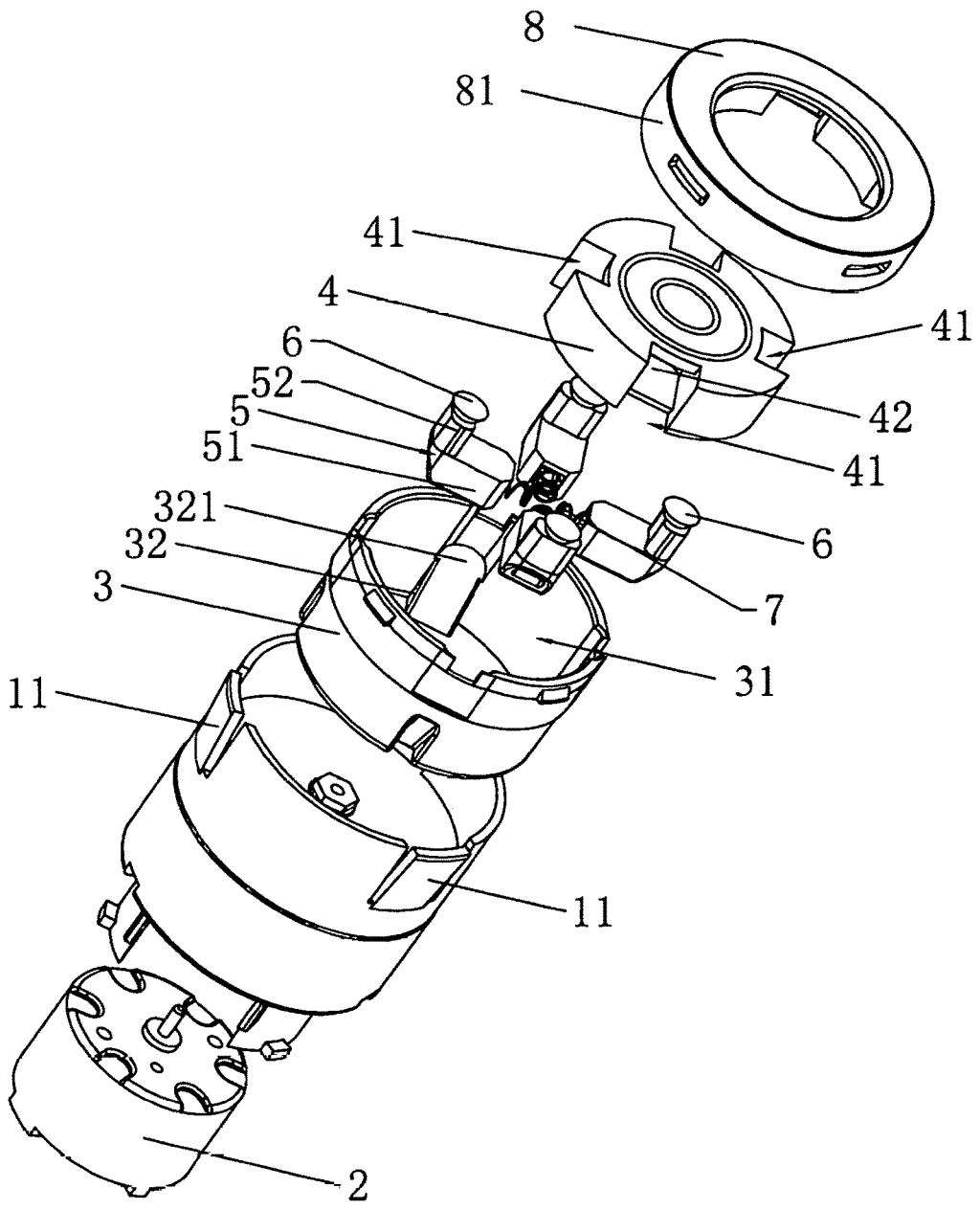
FIG. 2 is an exploded schematic diagram of the present utility model.
Figure 3:
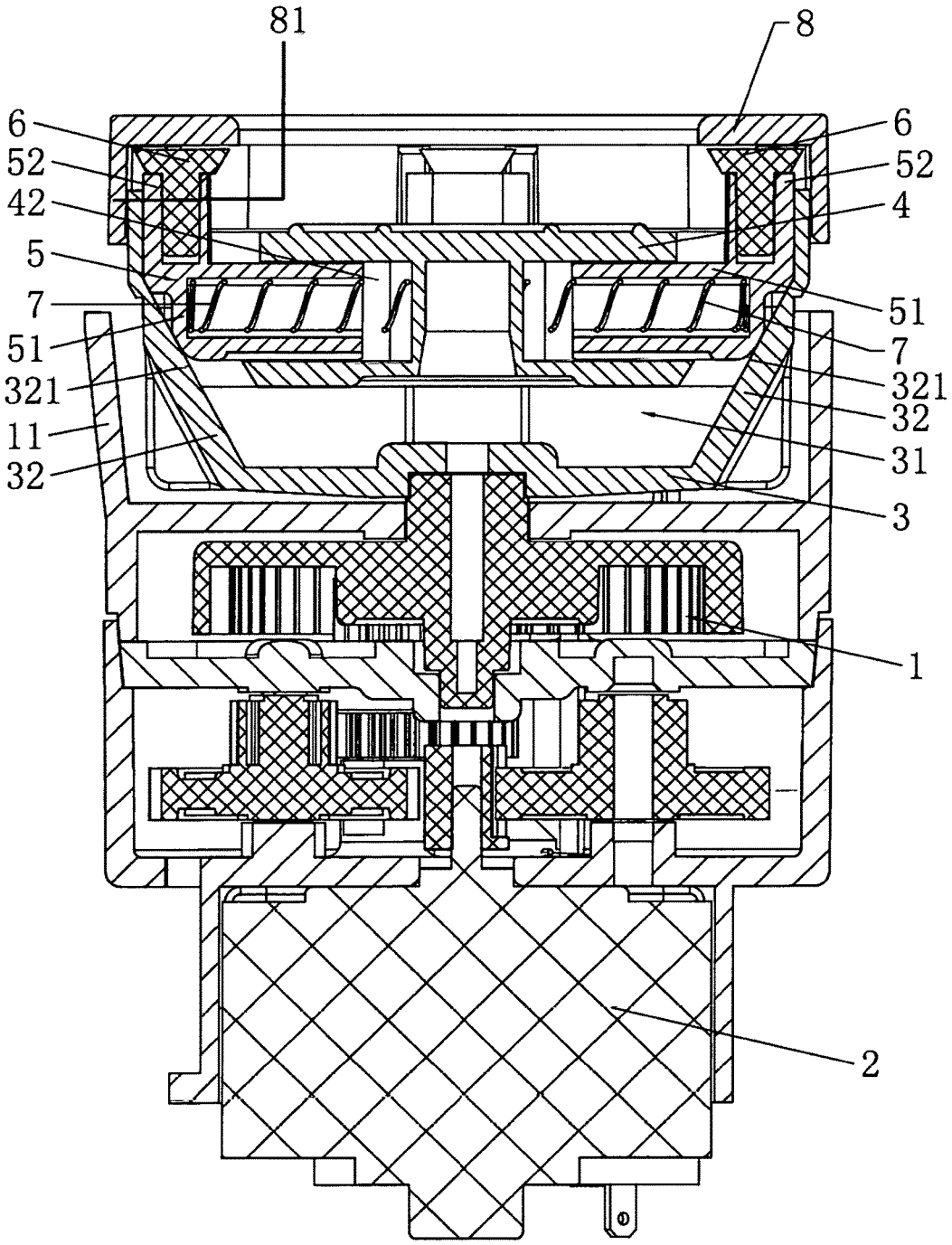
FIG. 3 is a sectional schematic diagram of the present utility model.

Included in FIG. 1 to FIG. 3 are:

| | |
|---|---|
| 1 Reduction gearbox | 11 Retaining projection |
| 2 Driving motor | 3 Movable support |
| 31 Support receiving cavity | 32 Support limit projection |
| 321 Guide slope | 4 Blade-mounting carrier |
| 41 Mounting carrier limit notch | 42 Blade-mounting hole |
| 5 Blade-mounting block | 51 Horizontal mounting block portion |
| 52 Vertical mounting block portion | 6 Tinfoil-cutting blade |
| 7 Horizontal spring | 8 Protective cover |
| 81 Protecting flange. | |

DETAILED DESCRIPTION OF THE INVENTION

The present utility model is described below with reference to specific embodiments.

As shown in FIG. 1 to FIG. 3, disclosed is an electric tinfoil-cutting device for automatic corkscrews, which comprises a reduction gearbox 1 and a driving motor 2 mounted at a lower end of the reduction gearbox 1, a power output shaft of the driving motor 2 is connected to a power input end of the reduction gearbox 1, a movable support 3 is mounted at un upper end of the reduction gearbox 1, a power output end of the reduction gearbox 1 is connected to the movable support 3, and a support receiving cavity 31 with an upward opening is formed in the movable support 3.

Further, a blade assembly is embedded in the support receiving cavity 31 of the movable support 3, the blade assembly comprises a blade-mounting carrier 4 which is embedded in the support receiving cavity 31, the edge of the blade-mounting carrier 4 is provided with at least two mounting carrier limit notches 41 which both open radially outwardly and are completely through from the top down, an internal wall of the support receiving cavity 31 is provided with inwardly raised and wedged support limit projections 32 which correspond to the mounting carrier limit notches 41, respectively, and each support limit projection 32 is provided with an inclined guide slope 321 and is embedded in a corresponding mounting carrier limit notch 41; the blade-mounting carrier 4 is provided, corresponding to respective mounting carrier limit notches, with blade-mounting holes 42 open radially outwardly and communicate with the corresponding mounting carrier limit notches 41, an L-shaped blade-mounting block 5 is embedded in each blade-mounting hole 42, each blade-mounting block 5 comprises a horizontally extending horizontal mounting block portion 51 and a vertically extending vertical mounting block portion 52 integrated with the horizontal mounting block portion 51, the horizontal mounting block portion 51 of each blade-mounting block 5 is embedded in the corresponding blade-mounting hole 42, an upper end of the vertical mounting block portion 52 of each blade-mounting block 5 extends to an upper end side of the blade-mounting carrier 4, and a tinfoil-cutting blade 6 is mounted at an upper end of the vertical mounting block portion 52 of each blade-mounting block 5.

Further, a horizontal spring 7 is embedded in each blade-mounting hole 42 on the inner side of the horizontal mounting block portion 51 of the corresponding blade-mounting block 5, an inner end of each horizontal spring 7 abuts against the blade-mounting carrier 4, and an outer end of each horizontal spring 7 abuts against the horizontal mounting block portion 51 of the corresponding blade-mounting block 5.

During operation of the present utility model, the electric tinfoil-cutting device is inverted, the bottleneck of a winebottle is put in between the tinfoil-cutting blades 6, the electric tinfoil-cutting device is pressed downward such that the bottleneck of the winebottle upwardly pushes the blade-mounting carrier 4, and under the pushing action of the bottleneck of the winebottle, the blade-mounting carrier 4 moves towards the bottom of the support receiving cavity. In this process, under the guiding effect of the guide slopes 321 of the support limit projections 32, each blade-mounting block 5 gradually moves inwards, and each blade-mounting block 5 drives the corresponding tinfoil-cutting blade 6 to move inwards until the edge of each tinfoil-cutting blade 6 is finally in contact with a tinfoil on the periphery of the bottleneck of the winebottle. After the edge of each tinfoil-cutting blade 6 is in contact with the tinfoil, the driving motor 2 is started. The driving motor 2 drives the movable support 3 to rotate after being decelerated by the reduction gearbox 1, the movable support 3 drives the blade-mounting carrier 4 to rotate synchronously, the rotating blade-mounting carrier 4 drives each blade-mounting block 5 and each tinfoil-cutting blade 6 to rotate, and the rotating tinfoil-cutting blades 6 carry out tinfoil-cutting.

It should be further pointed out that after the tinfoil-cutting operation is complete, under the effect of the restoring elastic force of the horizontal springs 7, each horizontal spring 7 outwardly pushes the horizontal mounting block portion 51 of each blade-mounting block 5, each blade-mounting block 5 drives the corresponding tinfoil-cutting blade 6 to move outwards, and moreover, due to the guiding effect of the guide slopes 321, the tinfoil-cutting blades 6, the blade-mounting blocks 5 and the blade-mounting carrier 4 return to the initial positions.

It can be known from the above that by means of the above-mentioned structural design, the present utility model can achieve the automatic tinfoil-cutting function, that is, the electric tinfoil-cutting device of the present utility model has the advantages of novel structural design, high automation degree and convenience in use.

As a preferred embodiment, as shown in FIG. 1 to FIG. 3, an annular protective cover 8 is buckled at the upper end of the movable support 3, and the protective cover 8 is provided with a protective flange 81 which inwardly protrudes and extends and is located at the upper end sides of the tinfoil-cutting blades 6. During operation of the present utility model, the protective flange 81 of the protective cover 8 extends to the upper end of each tinfoil-cutting blade 6 and hides each tinfoil-cutting blade 6, and therefore this structural design can effectively increase the safety of the present utility model and avoid accidental cuts.

As a preferred embodiment, as shown in FIG. 1 to FIG. 3, the upper end of the reduction gearbox 1 is provided with retaining projections 11 which allow the electric tinfoil-cutting device of the present utility model to be retained and positioned in a shell of an automatic corkscrew.

The above descriptions are merely preferred embodiments of the present utility model. For the ordinary skilled in the art, both the specific embodiment and the application range will be altered according to the concept of the present utility model, and the content of the specification should not be interpreted as a limitation on the present utility model.

What is claimed is:

1. An electric tinfoil-cutting device for automatic corkscrews, characterized in that it comprises a reduction gearbox (1) and a driving motor (2) mounted at a lower end of the reduction gearbox (1), a power output shaft of the driving motor (2) is connected to a power input end of the reduction gearbox (1), a movable support (3) is mounted at an upper end of the reduction gearbox (1), a power output end of the reduction gearbox (1) is connected to the movable support (3), and a support receiving cavity (31) with an upward opening is formed in the movable support (3);

a blade assembly is embedded in the support receiving cavity (31) of the movable support (3), the blade assembly comprises a blade-mounting carrier (4) which is embedded in the support receiving cavity (31), an edge of the blade-mounting carrier (4) is provided with at least two mounting carrier limit notches (41) which both open radially outwardly and are completely through from the top down, an internal wall of the support receiving cavity (31) is provided with inwardly raised and wedged support limit projections (32) which correspond to the mounting carrier limit notch (41), respectively, and each support limit projection (32) is provided with an inclined guide slope (321) and is embedded in a corresponding mounting carrier limit notch (41); the blade-mounting carrier (4) is provided, corresponding to respective mounting carrier limit notches (41), with blade-mounting holes (42) open radially outwardly and communicate with the corresponding mounting carrier limit notches (41), an L-shaped blade-mounting block (5) is embedded in each blade-mounting hole (42), each blade-mounting block (5) comprises a horizontally extending horizontal mounting block portion (51) and a vertically extending vertical mounting block portion (52) integrated with the horizontal mounting block portion (51), the horizontal mounting block portion (51) of each blade-mounting block (5) is embedded in the corresponding blade-mounting hole (42), an upper end of the vertical mounting block portion (52) of each blade-mounting block (5) extends to an upper end side of the blade-mounting carrier (4), and a tinfoil-cutting blade (6) is mounted at the upper end of the vertical mounting block portion (52) of each blade-mounting block (5); and a horizontal spring (7) is embedded in each blade-mounting hole (42) on an inner side of the horizontal mounting block portion (51) of the corresponding blade-mounting block (5), an inner end of each horizontal spring (7) abuts against the blade-mounting carrier (4), and an outer end of each horizontal spring (7) abuts against the horizontal mounting block portion (51) of the corresponding blade-mounting block (5).

2. The electric tinfoil-cutting device for automatic corkscrews according to claim 1, characterized in that an annular protective cover (8) is buckled at an upper end of the movable support (3), and the protective cover (8) is provided with a protective flange (81) which inwardly protrudes and extends and is located at an upper end side of the tinfoil-cutting blades (6).

3. The electric tinfoil-cutting device for automatic corkscrews according to claim 1, characterized in that the upper end of the reduction gearbox (1) is provided with retaining projections (11).

* * * * *